US005666031A

United States Patent [19]

Jennato et al.

[11] Patent Number: 5,666,031

[45] Date of Patent: Sep. 9, 1997

[54] NEON GAS DISCHARGE LAMP AND METHOD OF PULSED OPERATION

[75] Inventors: Scott Jennato, Candia; Harold L. Rothwell, Jr., Hopkinton, both of N.H.

[73] Assignee: Osram Sylvania Inc., Danvers, Mass.

[21] Appl. No.: 570,927

[22] Filed: Dec. 12, 1995

Related U.S. Application Data

[63] Continuation-in-part of Ser. No. 213,649, Mar. 16, 1994, Pat. No. 5,565,741, and Ser. No. 298,896, Aug. 31, 1994, Pat. No. 5,523,655.

[51] Int. Cl.[6] ..... H05B 41/16

[52] U.S. Cl. ..... 315/246; 315/291; 315/358; 313/637

[58] Field of Search ..... 315/246, 291, 315/77, 82, 358, 326, DIG. 2, DIG. 5; 313/637, 641, 642, 643

[56] References Cited

U.S. PATENT DOCUMENTS 5,043,634 8/1991 Rothwell, Jr. et al. ..... 315/246

*Primary Examiner*—Robert Pascal
*Assistant Examiner*—David Vu
*Attorney, Agent, or Firm*—William E. Meyer

[57] ABSTRACT

A pulse structure for operating a method neon lamp in a multi-colored light source is described along with its pertinence to automotive lighting. The particular neon lamps are mercury-free, low pressure, rare gas lamps that can be operated as efficient red, amber, and potentially white light sources in automotive and other lighting applications. The preferred pulse structure has a leading spike to ionize the neon and generate ultraviolet radiation, and has a trailing pulse to add energy to the lamp, which increases visible neon emission efficacy.

30 Claims, 12 Drawing Sheets

NEON GAS DISCHARGE LAMP AND METHOD OF PULSED OPERATION

This application is a Continuation-in-Part of Ser. No. 08/213,649 filed Mar. 16, 1994 (Method of Operating a Neon Lamp), now U.S. Pat. No. 5,565,741; and Ser. No. 08/298,896 filed Aug. 31, 1994 (Neon Fluorescent Lamp and Method of Operating), now U.S. Pat. No. 5,523,655.

TECHNICAL FIELD

The invention relates to electric lamps and particularly to discharge lamps. More particularly the invention is concerned with a method of operating a low pressure rare gas discharge lamp.

BACKGROUND ART

In the past, colored lamps have been made by placing a colored filter in front of a continuous spectrum tungsten filament lamp. The vast number of available filters makes almost any color possible. Unfortunately, tungsten filament lamps are not efficient, particularly when filtered; nor are they durable in comparison to discharge lamps. Discharge lamps can be much more efficient, and have a much longer life than a tungsten filament lamp. For example, a neon discharge lamp is presently being used on the Ford Explorer as a central high mounted stop lamp (CHMSL). The lamp has a 3.0 millimeter inner diameter, a 5.0 millimeter outer diameter, a low pressure neon fill, and a 47.10 centimeter arc gap. The lamp is driven by a 60 kHz sine wave and generates 220 lumens with an efficacy of 8 lumens per watt. It is expected to last for two thousand hours of operation, and eight hundred thousand starts. A typical neon emission spectrum is shown in FIG. 2.

Discharge lamp colors are the result of particular atomic emissions and are adjustable only by selecting different chemical compositions. Possible lamp colors are then determined by the limited number of useful gases, and phosphors, where a phosphor is used. Not all colors are available, nor are all colors efficiently produced. There is then a need for a method of operating discharge lamps that enables color tuning, while still operating efficiently.

SUMMARY OF THE INVENTION

A positive column discharge lamp having a rare gas fill and a phosphor coating may be operated to provide a combined color by shaping the input power pulse. The power pulse is chosen to have at least a first portion generally prior in time and a second portion generally later in time, where the first portion has a pulse width selected to excite ultraviolet photon emission from the rare gas, and the second portion having a pulse width selected to enhance the additional visible light output from the rare gas, while applying otherwise sufficient voltage and current to cause ionization of the lamp fill.

BEST MODE FOR CARRYING OUT THE INVENTION

Figure 1:
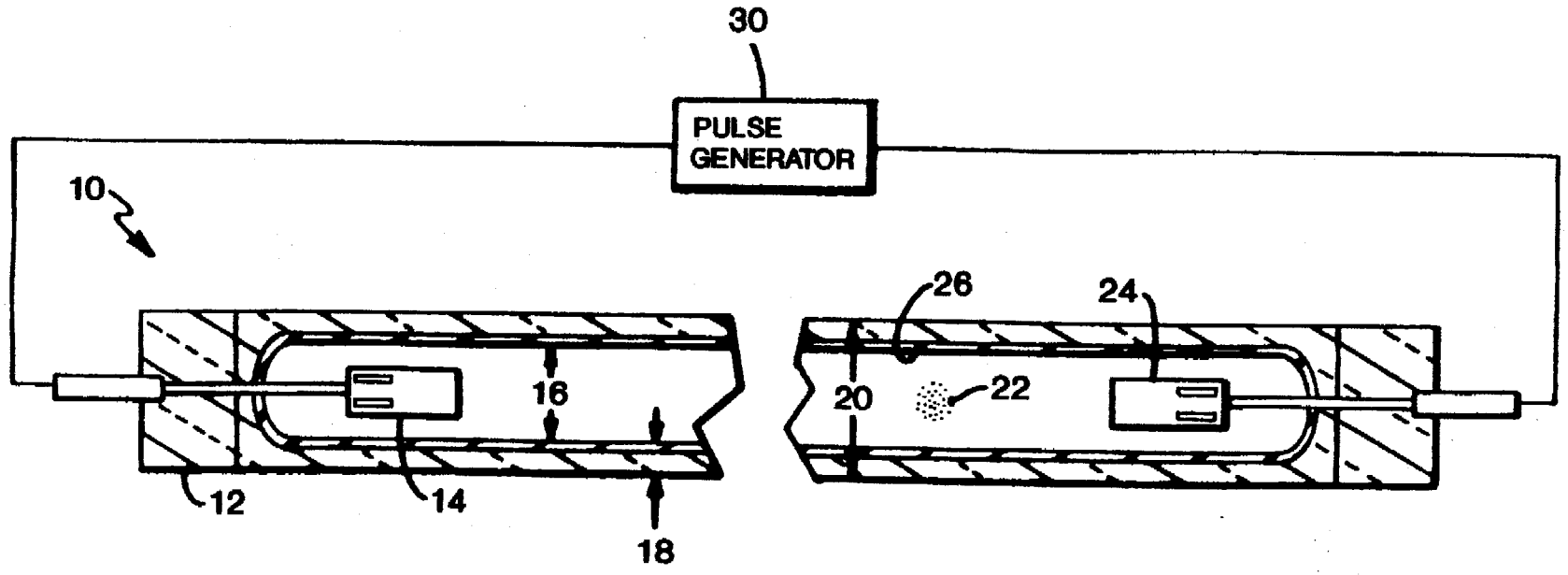
FIG. 1 shows a cross sectional view, partially broken away of a phosphor coated neon lamp and pulsed power supply.

FIG. 1 shows a cross sectional view, partially broken away of a preferred embodiment of a neon fluorescent lamp. The neon stop lamp 10 for a vehicle is assembled from a tubular envelope 12, a first electrode 14, a neon gas fill 22, a second electrode 24, and a phosphor coating 26. The lamp is operated by a pulse generator 30.

The tubular envelope 12 may be made out of hard or soft glass or quartz to have the general form of an elongated tube. The selection of the envelope material is somewhat important. The preferred glass does not devitrify, or outgas at the temperature of operation, and also substantially blocks the loss of neon. One suitable glass is an alumina silicate glass, a "hard glass," available from Corning Glass Works, and known as type 1724. Applicants have found that the 1724 hard glass stops nearly all neon loss. The 1724 glass may be baked at 900 degrees Celsius to drive out water and hydrocarbons. The hot bake out improves the cleanliness that helps standardize the color produced, and improves lamp life.

Common neon sign lamps use low pressure (less than 10 Torr), and produce low intensity discharges with low brightness. The envelope tubes are made from lead, or lime glasses that are easily formed into the curved text or figures making up the desired sign. The bent tubes are then filled and sealed. These glasses if operated at the higher temperatures of a more intense discharge release the lead, or other chemical species of the glass into the envelope. The glass is then devitrified, or stained, or the gas chemistry is changed resulting in a lamp color change. Using pure quartz is not fully acceptable either, since pure quartz has a crystal structure that allows neon to diffuse through. Neon loss from the enclosed volume depends on the lamp temperature, and gas pressure, so for a higher pressure lamp, more neon is lost, resulting in a greater pressure and color change. There are additional optical and electrical changes that occur as the neon loss increases.

The envelope 12's inside diameter 16 may vary from 2.0 to 10.0 millimeters, with the preferred inside diameter 16 being about 3.0 to 5.0 millimeters. Lamps have been found to work marginally well at 9 or 10 millimeters inside diameter. Better results occur at 5 millimeters, and 3 millimeters appears to be the best inside diameter. The preferred envelope wall thickness 18 may vary from 1.0 to 3.0 millimeters with a preferred wall thickness 18 of about 1.0 millimeter. The outside diameter 26 then may vary from 4.0 millimeters to 16.0 millimeters with a preferred outside diameter 28 of 5.0 to 7.0 millimeters. Tubular envelopes have been made with overall lengths from 12.7 centimeters to 127 centimeters (5 to 50 inches). The overall length for a positive column emission is thought to be a matter of designer choice.

At one end of the tubular envelope 12 is a first sealed end. The first sealed end entrains the first electrode 14. The preferred first sealed end is a press seal capturing the first electrode 14 in the hard glass envelope. Positioned at the opposite end of the tubular envelope 12 is a second sealed end. The second sealed end may be formed to have substantially the same structure as the first seal, capturing a similarly formed second electrode 24. It is understood that lamp 10 is to be operated as a positive column, so the electrodes are separated sufficiently to allow formation of a positive column discharge.

Electrode efficiency, and electrode durability are important to overall lamp performance. The preferred electrode is a cold cathode type with a material design that is expected to operate at a high temperature for a long lamp life. It is understood that hot cathode or electrodeless lamps may possibly be made to operate using the method of operation. A molybdenum rod type electrode may be formed to project into the enclosed envelope volume, with a cup positioned and supported around the inner end of the electrode rod. The cup may be formed from nickel rolled in the shape of a cylinder. A tantalum rod or cup type electrode is preferred for durability.

The region between the electrode tip and the inner wall of the cup may be coated or filled with an electrically conductive material that preferably has a lower work function than does the cup. The fill material is preferably an emitter composition having a low work function, and may also be a getter. The preferred emitter is an alumina and zirconium getter material, known as Sylvania 8488 that is spun deposited and baked on to provide an even coating. The cup surrounds the emitter tip, and extends slightly farther, perhaps 2.0 millimeters, into the tubular envelope than the inner most part of the electrode rod, and the emitter material extends. Emitter material, or electrode material that might sputter from the emitter tip tends to be contained in the extended cup.

The preferred rare gas fill 22 is substantially pure, research quality neon. The Applicants have found that purity of the neon fill, and cleanliness of the lamp are important in consistently achieving proper lamp color. Similarly, no mercury is used in the lamp. While mercury reduces the necessary starting voltage in a discharge lamp, mercury also adds a large amount of blue, and ultraviolet light to the output spectrum. Mercury based lamps are also difficult to start in cold environments, an undesirable feature for a vehicle lamp. While other gases, such as argon, helium, krypton, nitrogen, radon, xenon and combinations thereof, could be included in the lamp, in minor concentrations (substantially pure). Otherwise these gases quickly affect the starting conditions, operating conditions and output color. In general these other gases have lower energy bands than neon, and therefore even in small quantities, tend to either dominate the emission results, or quench the neon's production of ultraviolet and visible light. Pure, or substantially pure neon is then the preferred neon lamp fill.

The gas fill 22 pressure affects the color output of the lamp. Increasing pressure shortens the time between atomic collisions, and thereby shifts the population of emitting neon species to a deeper red. By adjusting the pressure, one can then affect the lamp color. At pressures below 25 Torr, the chromaticity is outside the SAE red range. At 70 Torr the neon gives an SAE acceptable red with chromaticity figures of (0.662, 0.326). At 220 Torr, the color still meets the SAE requirements, but has shifted to a deeper red with coordinates of (0.670, 0.324). With decreasing pressure the emitted light tends to be orange.

The neon gas fill 22 may have a preferred pressure from 20 Torr to 220 Torr. At pressures of 10 Torr or less, the electrodes tend to sputter, discoloring the lamp, reducing functional output intensity, and threatening to crack the lamp by interacting the sputtered metal with the envelope wall. At pressures of 220 Torr or more, the ballast must provide a stronger electric field to move the electrons through the neon, and this is less economical. Lamps above 300 Torr of neon are felt to be less practical due to the increasing hardware and operating expense. The effect of pressure depends in part on lamp length (arc gap). The preferred pressure for a 30.48 centimeter (12 inch) lamp is about 100 Torr.

The lamp envelope is further coated with a phosphor 26 responsive to the ultraviolet radiation lines of neon. Several phosphors are known, and normally they are adhered to the inside surface of the lamp envelope. They may be attached to other surfaces formed in the interior of the envelope. Almost any phosphorescent mineral held in a binder is thought to be potentially useful. The preferred phosphor 26 for amber color, has an alumina binder and includes yttrium alumina ceria. Applicants use Sylvania type 251 phosphor, whose composition includes $Y_3{:}A_{15}O_{12}{:}Ce$. Applicants have also found willemite (zinc orthosilicate) phosphors are responsive to neon ultraviolet emissions, but these are less preferred.

Figure 11:
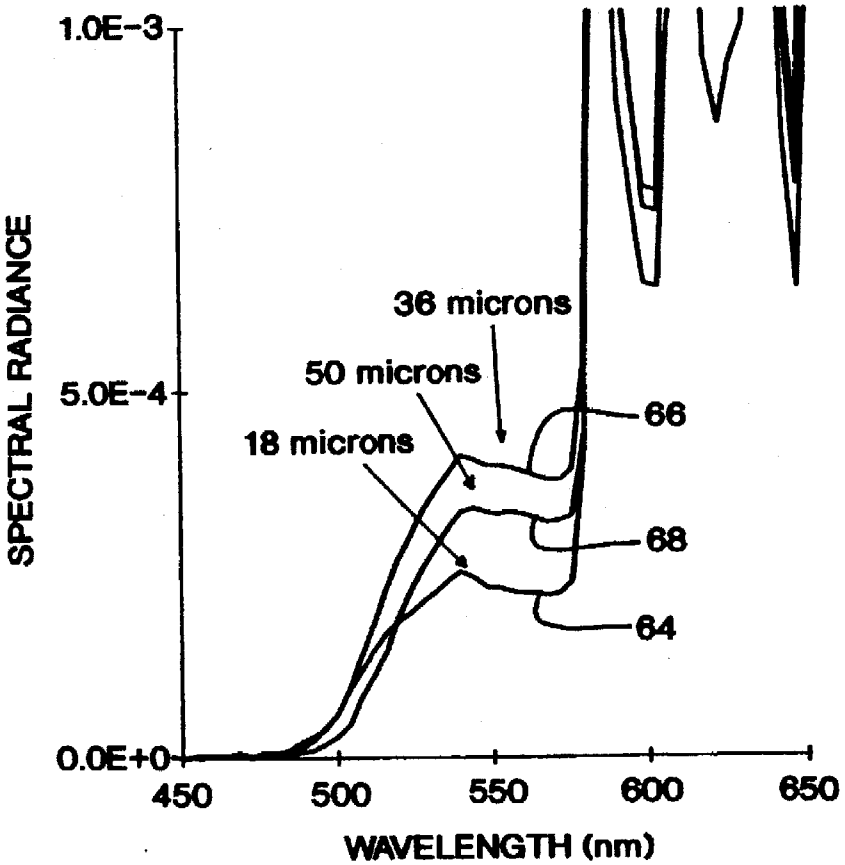
FIG. 11 shows comparison chart of spectral radiance from a YAG phosphor coated neon lamp using three different phosphor thicknesses.

The thickness of the phosphor affects the lamp color, since the lamp emission is due to the visible emissions from the neon gas and the phosphor. Increasing the phosphor thickness, increases the phosphor emission up to a saturation point. At the same time, increasing the phosphor thickness decreases the transmission of the visible neon emission. The phosphor thickness then to a degree controls the relative amount of the two emissions, and therefore the combined color. The desirable phosphor coating thickness is then determined by simple testing. FIG. 11 shows the affect of phosphor coating thicknesses of 18, 36 and 50 microns respectively charted as curves 64, 66 and 68. The greatest radiance was achieved with a coating of 36 microns.

The lamp is operated by a pulse generator 30 to give the neon red color, or the combined phosphor and neon colors. The red mode may be accomplished by delivering either direct current or continuous wave alternating current power. To activate the phosphor and form the prescribed color through the mixing of the neon and phosphor emissions, pulse-mode power is used. The Applicants have used circuits like that in FIG. 12 to generate pulses. Varying the component specifications changes the respective primary 46 and secondary 48 pulse widths. The rise time and peak voltage of the voltage pulse to the lamp is controlled by capacitor C6 plus the sum of the parasitic capacitance associated with the transformer's secondary winding, the lamp and its wiring and the peak current developed in the primary of transformer T1 during the conduction cycle of Q2. When Q2 turns off the current flowing in the primary continues to flow into capacitor C6 in parallel with the parasitic capacitances. This results in a sinusoidal increase in voltage which continues until the lamp ignites at which point the lamp presents a low impedance across the output of the transformer. The charge stored in capacitor C6 and the parasitic capacitances now discharge through the lamp. The rise time of the current pulse is determined by the resistance of the transformer windings and the leakage inductance of transformer T1 secondary as well as the total value of capacitance The discharge continues until the capacitor's C6 voltage as stepped up by the transformer T1 is not sufficient to maintain current through the lamp greater than what the stored energy in the transformer core can maintain. At this point the energy stored in the transformer is transferred to the lamp resulting in a secondary current pulse of longer duration than the primary pulse. Whereas the primary pulse time constants is controlled by the leakage inductance and winding resistance, the secondary current pulse time constant is controlled by the secondary inductance and the lamp voltage. This results in a relatively long secondary current pulse versus the much shorter primary current pulse.

The amount of energy that is contained in the primary pulse 46 versus the secondary pulse 48 is determined by the amount of energy that gets transferred from the transformer T1 to the capacitors described above before the lamp lights. Adjusting the value of C6 so that the lamp lights at the point at which all the energy from the transformer has been transferred to the capacitor results in most of the energy being contained in the primary pulse 46. Conversely, adjusting the value of C6 such that lamp ignition occurs prior to all the energy being transferred to C6 results in an increasing energy content in the secondary pulse 48 depending upon the ratio of capacitor to transformer stored energy at the time of lamp ignition. Similarly adjusting C6 such that lamp ignition occurs after all the energy has been transferred to the capacitor and energy has started transferring back to the transformer results in an increasing energy content of the secondary pulse.

During an electrical discharge, the neon gas is excited through collisions. For low pressure neon, such as a few torr, the average time between atomic collisions is long compared to the lifetimes of the excited states. The Applicants have found that under these conditions, it is possible through electrical excitation to have some control over the relative numbers of atoms excited neon atoms in the various excited states. By varying the relative populations in selected states, lamp color may be varied. In particular, one can increase or decrease the visible radiation in the red color regime relative to the ultraviolet radiation for phosphor stimulation.

The Applicants found that by electrically operating a neon discharge under pulse mode excitation, as compared to sinusoidal excitation, lamp efficacy can be increased by 50 to 70 percent. Besides increasing lamp efficacy, the Applicants also observed that due to changes in the relative intensity of visible spectrum emission lines, the chromaticity of the lamp changes. When the excitation pulse widths were narrowed, the color of the neon lamp shifted away from the red towards the orange. It was initially believed that a direct emitting amber light source could be made by selectively pulsing a pure neon gas lamp with no phosphor. Such a neon lamp could then be used on an automobile rear with a first power format to make red light for brake signaling, and using a second power format to make amber light for turn signaling. Direct emission of amber color by pulsing neon without using a phosphor was not satisfactorily achieved.

Phosphor coated neon lamps were therefore investigated. Due to the temperature extremes automobiles experience, as well as the desire to limit the possible environmental hazards, mercury is considered an undesirable fill component. Lamps with phosphors excited by neon emissions were investigated.

Figure 3:
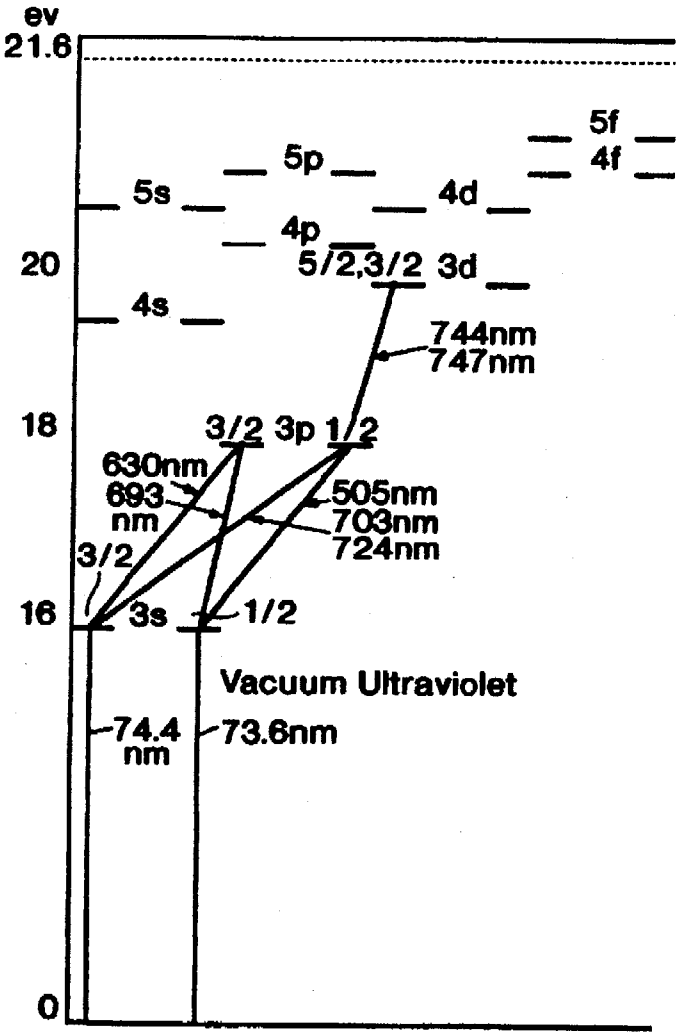
FIG. 3 shows a chart of a partial term diagram for energy transitions states for neon showing the vacuum ultraviolet energy transitions at 74.4 nanometers, and 73.6 nanometers used to excite phosphor.
Figure 2:
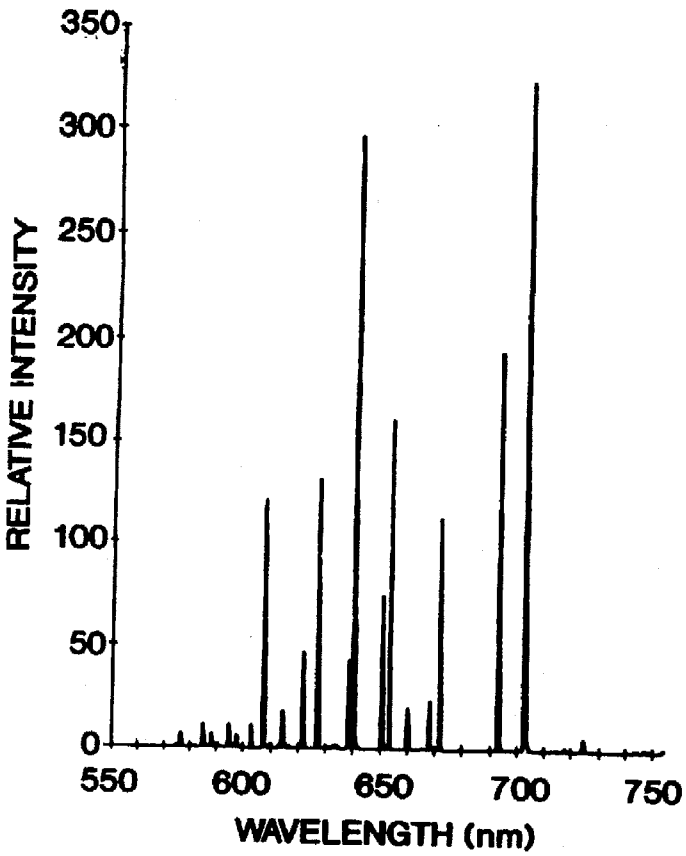
FIG. 2 shows a chart of emission spectrum from a neon vehicle lamp.
Figure 4:
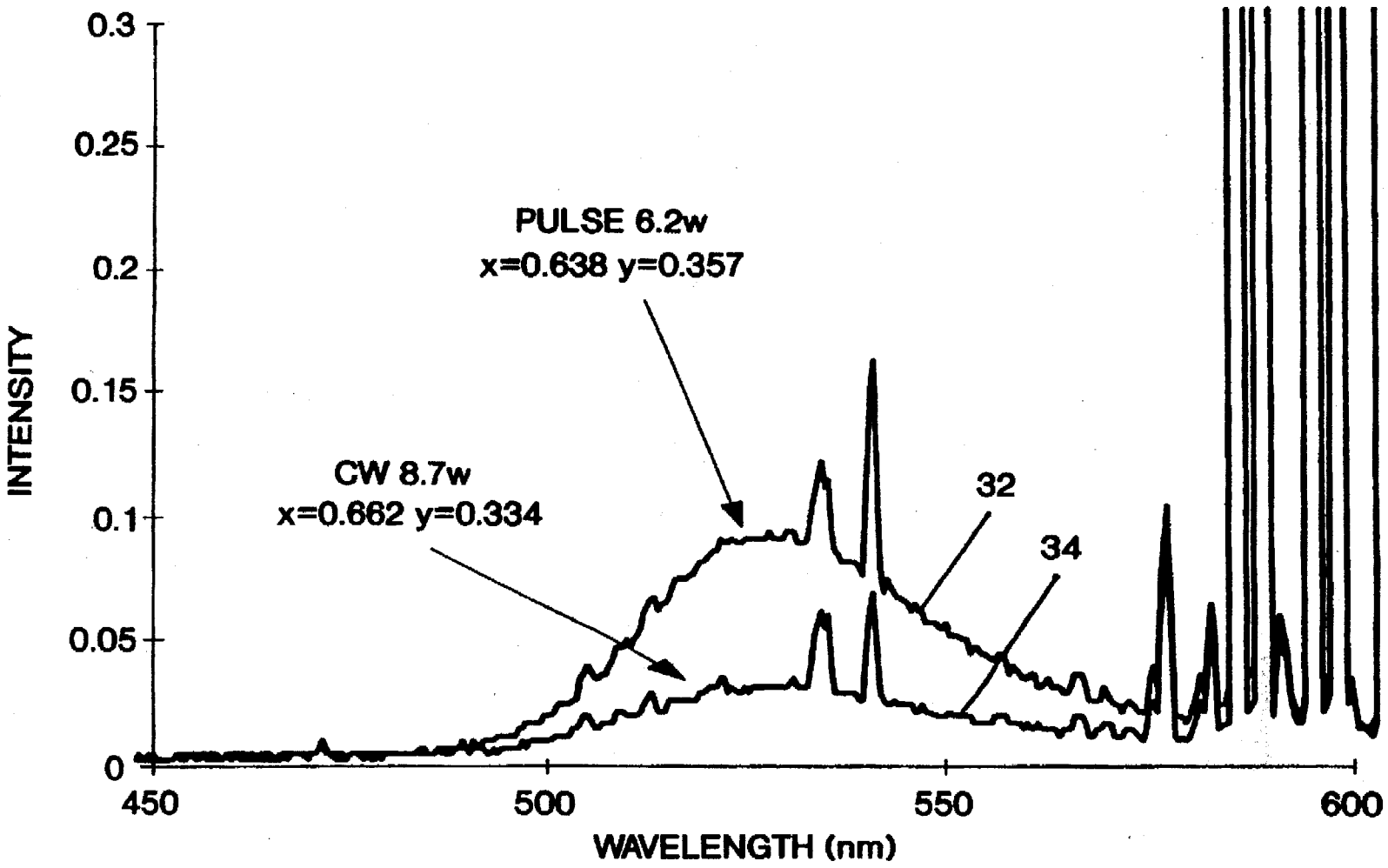
FIG. 4 shows a comparison chart of the spectral output of a neon lamp with a willemite phosphor operated in continuous wave and pulsed formats.

A green emitting phosphor may be used to blend with the red spectral emission of neon, to form an amber color. Willemite ($Zn_2SiO_4$:Mn), a green emitting phosphor, was tried. Willemite has been measured to have a quantum efficiency of 1.5 at an excitation wavelength of 74 nanometers, a neon resonance line. FIG. 3 shows a chart of a partial term diagram for energy transitions states for neon I showing the vacuum ultraviolet energy transitions of 74.3 and 73.6 nanometers used to excite the phosphor FIG. 4 shows a comparison chart of the spectral output of a neon lamp with a willemite phosphor operated in continuous wave and pulsed formats. The lamp had a 100 torr pressure of neon fill, a 25.4 centimeter gap (10 inch) arc, a 3.0 millimeter inner diameter and a 5.0 millimeter outer diameter with a cylindrical glass envelop in a cold cathode electrode configuration. Trace 32 shows the more intense result with pulse mode operation, while trace 34 shows the less intense result with continuous wave mode operation.

In FIG. 4, the presence of the phosphor emission is apparent but, it is also important to recognize the difference in the intensities of the phosphor emission when the lamp is excited by an electrical pulse (trace 32) compared to a sinusoidal continuous wave (cw) (trace 34). From an electrical standpoint, pulsing stimulates the phosphor better than does sinusoidal operation. Similar willemite-neon lamps were operated for up to 4000 hours and were found to have almost no change in chromaticity over the period. A variety of pulse widths and frequencies were experimentally tested. Neon lamps using either of two willemite phosphors, Sylvania 2288 and 2282, were able to produce amber light meeting the SAE specification. The lamps using these phosphors were not as efficient as the YAG phosphor (Sylvania 251 and 157) coated lamps. Neon lamps using two other willemite phosphors, Sylvania 1643 and 2283 did not produce the proper amber color. The results, nonetheless, confirm the concept of adjusting lamp output color by varying the pulse shape. Lamps made with a combination of willemite and yttrium have achieved the correct amber color.

The ultraviolet emissions of atomic neon include, discrete emission lines between 335 to 375 nanometers with peak intensities at approximately 347 and 359 nanometers. These lines are considerably less intense than some of the stronger visible neon lines. To take advantage of these ultraviolet emission lines, a green phosphor capable of being excited by these lines is needed. A YAG phosphor (yttrium, alumina, garnet) (Sylvania 251) with a green output with a peak excitation at 341 nanometers, and giving chromaticity values of X=0.431 and Y=0.551 was selected. This chromaticity would meet the SAE specification.

Color blending calculations done with these chromaticity values and those of atomic neon, showed an amber color was feasible. An experimental neon lamp was constructed and tested. The basic construction of the lamp was exactly the same as the willemite-neon lamps. It was operated by 60 kHz sine waves (cw) and by a direct current pulse. The pulse used was the same as the one used to excite the willemite-neon lamp in FIG. 4.

Figure 5:
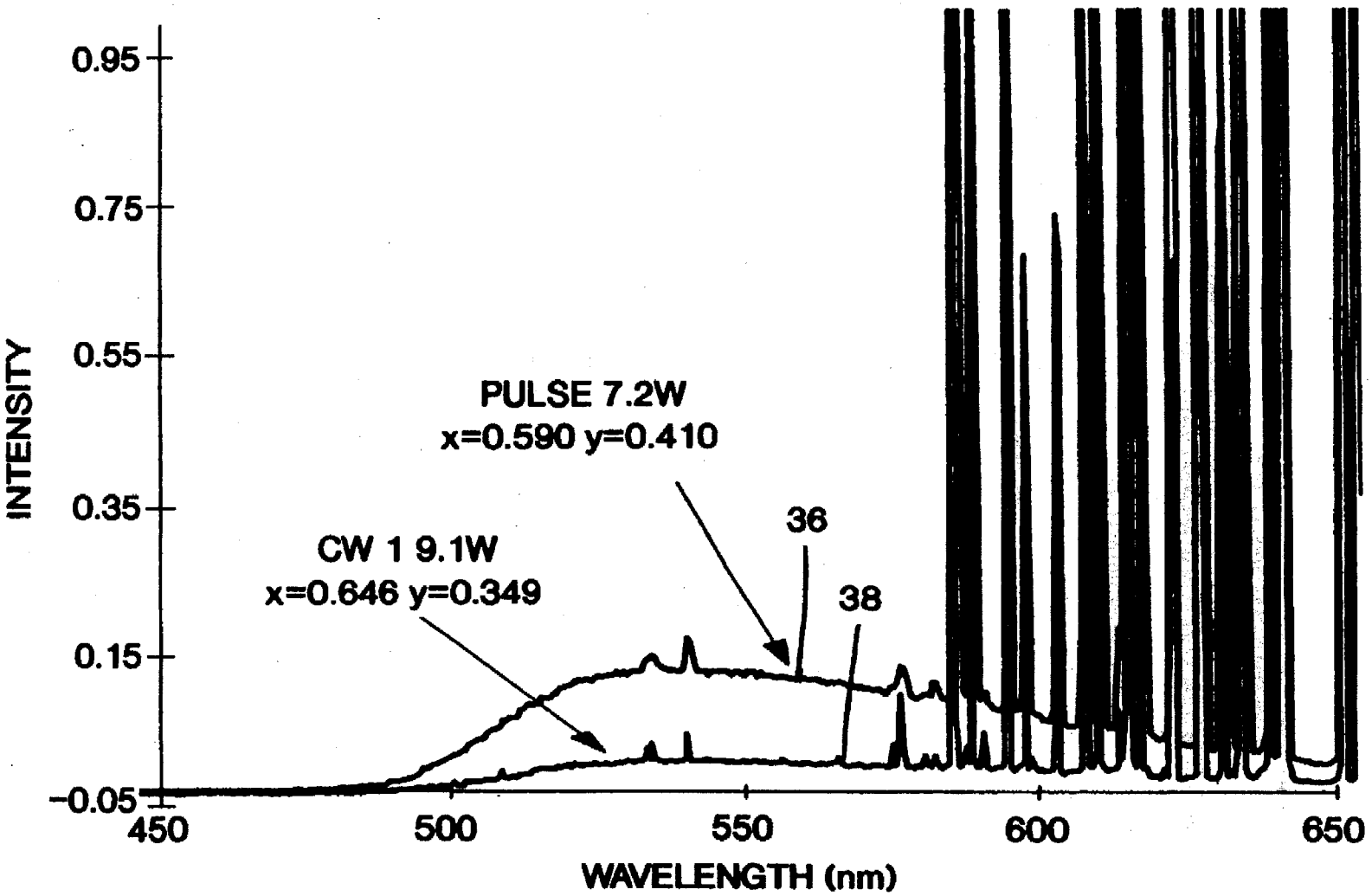
FIG. 5 shows a comparison chart of the spectral output of a neon lamp with a YAG phosphor operated in continuous wave and pulsed formats.

FIG. 5 shows a comparison chart of the spectral outputs of a neon lamp with the YAG phosphor operated in continuous wave and pulsed formats. FIG. 5 displays, pulsing (trace 36) stimulates the phosphor better than continuous wave excitation (trace 38). There is again a change in the chromaticity values for the two forms of electrical excitation. The pulsed operation generated chromaticity values of X=0.590 and Y=0.410; while the continuous wave operation gave values of X=0.646 and Y=0.349. The pulsed values placed the lamp color in the amber region of the CIE Chromaticity Diagram. The pulsed neon lamp generated approximately 115 lumens at 7.2 watts of lamp power. Several of the amber neon pulsed systems were put on life test, operated at 7 watts and evaluated. After one million starts, the lamps were found to exhibit no phosphor or color degradation.

To determine the cause of the varying phosphor emission under continuous wave excitation compared to pulse excitation, spectral data was gathered on the lamp in the ultraviolet region. Based on accurate spectral measurements, the neon discharge generates approximately the same amount of near ultraviolet radiation when operated under either continuous wave or pulse excitation. The near ultraviolet radiation in the neon lamp probably accounts for small levels of excitation in the phosphor; however, it does not account for the spectral emission differences in the phosphor under the varying pulsed electrical operations.

The Society of Automotive Engineers (SAE) says an amber turn signal system should generate a minimum of 200 candelas at horizontal-vertical (HV). Typically, every 10 lumens generated from an ordinary neon lamp, can be translated into approximately one (1.0) candela. Using an average machine-polished metallized aluminum parabolic reflector with an average focal point for a small packaged automotive housing, an average candela gain of 10 can be achieved at horizontal-vertical. A realistic operating power for a neon lamp is then believed to be about 23 to 25 watts.

Figure 6:
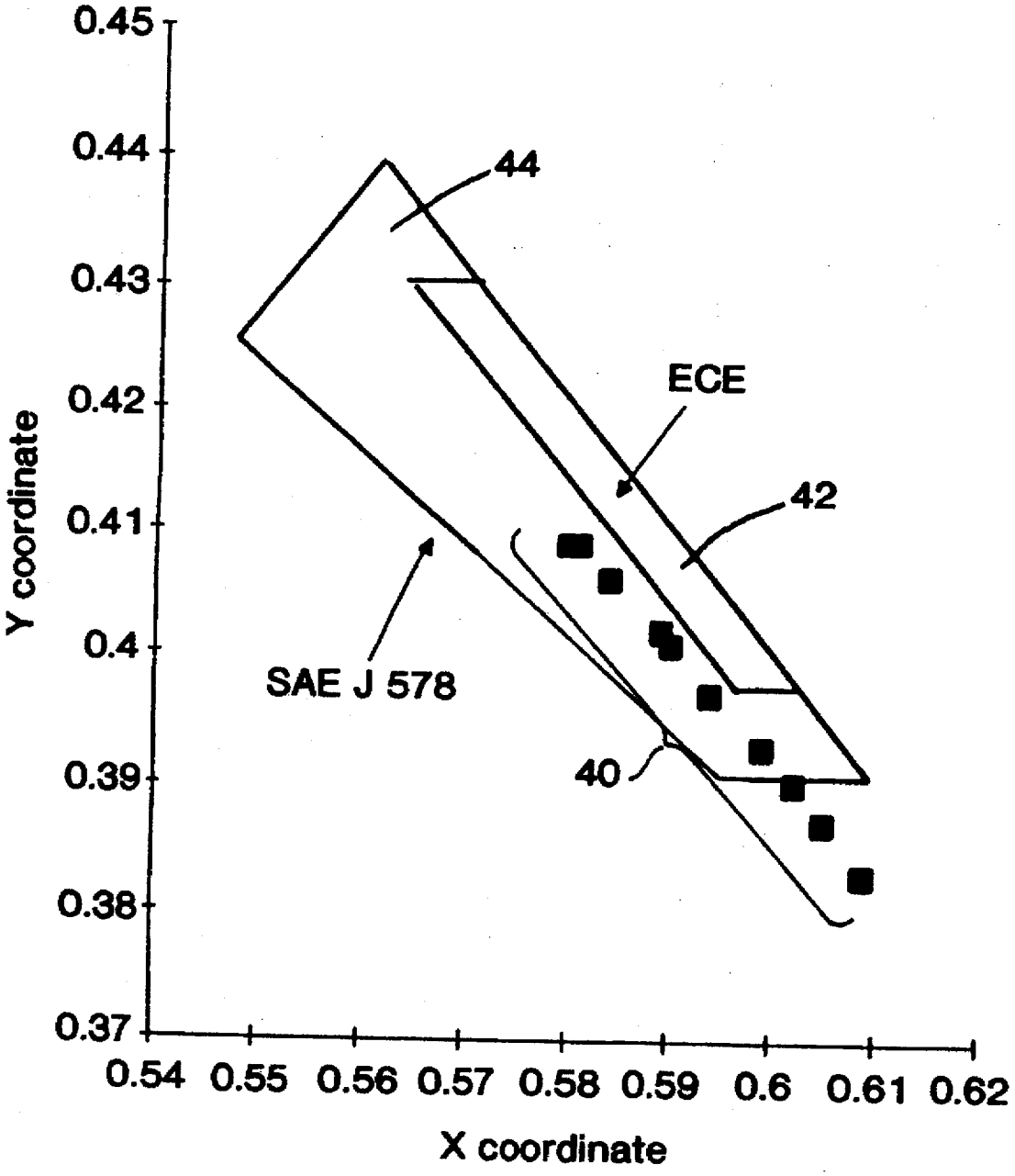
FIG. 6 shows a chart of chromaticity values for a phosphor coated, neon filled lamp for current pulses with different duty cycles.

FIG. 6 shows a chart of chromaticity values for a phosphor coated, neon filled lamp for current pulses with different duty cycles. By varying duty cycle of the current pulse, the color of the lamp can be manipulated. A low pressure, 25.4 centimeter phosphor coated, neon lamp, run between 6 to 10 watts, was operated with different pulse widths. The resulting string of different chromaticity points 40 for the different pulse widths is shown in FIG. 6 The wider the pulse, the redder the lamp color. The narrower the pulse, the more yellow or green the lamp color. Also shown in FIG. 6 are the European (ECE), region numbered 42; and the US (SAE J 578), region numbered 44, defining the allowed automotive chromaticity specifications (regions) for amber light.

Figure 7:
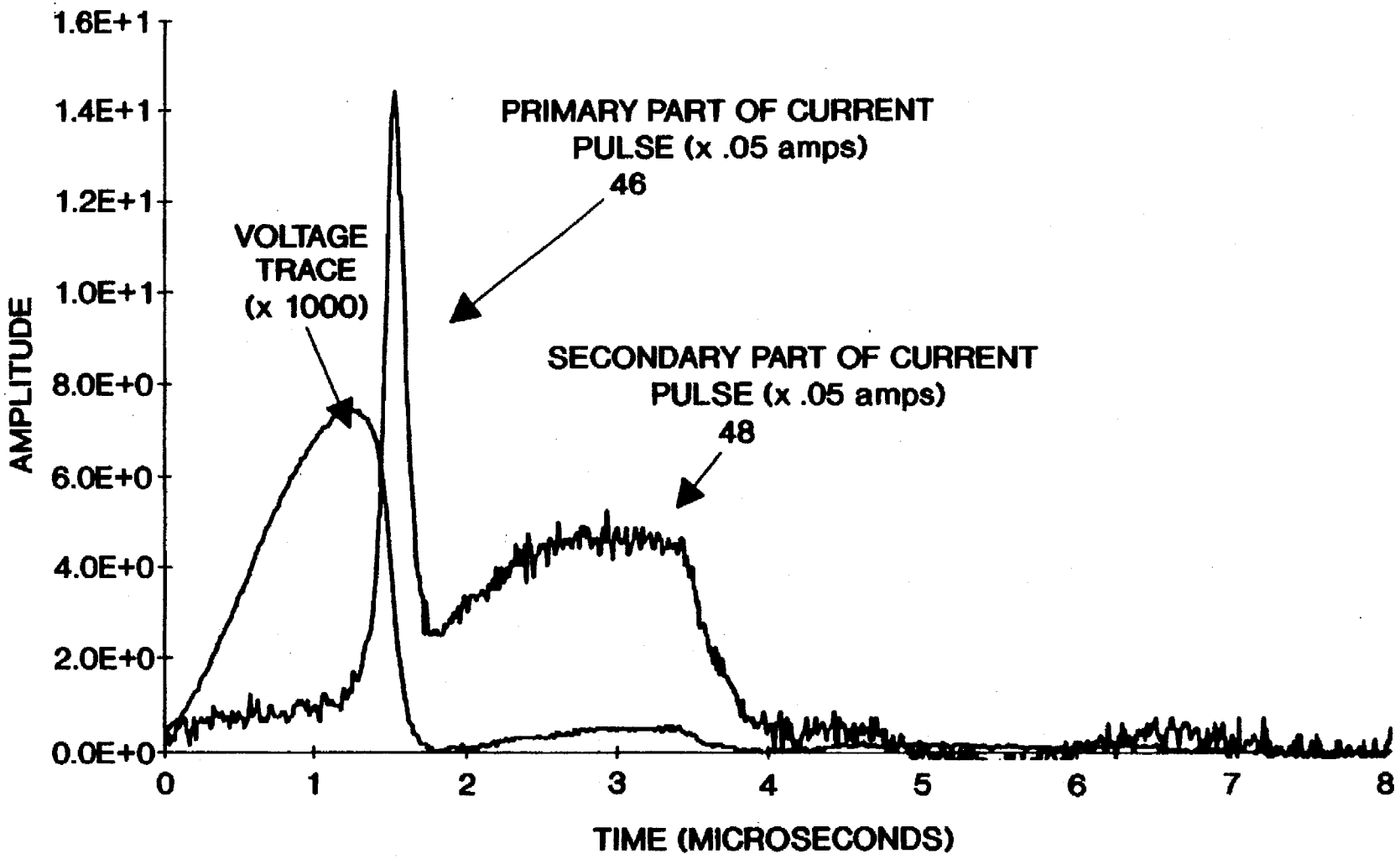
FIG. 7 shows a chart tracing the preferred current and voltage for an electrical pulse for a YAG phosphor coated, neon lamp.

FIG. 7 shows a chart tracing the preferred current and voltage for an electrical pulse for a 30.48 centimeter (12 inch), 100 torr pressure, YAG phosphor coated, neon lamp run at approximately 15 watts. The whole pulse may be viewed as an overlay of two pulses. The first portion, primary pulse 46, has a high, although narrow peak that is generally prior in time. The second portion, secondary pulse 48, has a much lower peak, generally somewhat later in time, but it extends over a greater period of time. Pulse width may be defined as the width about the peak to the points on either side having half the peak amplitude value.

Figure 8:
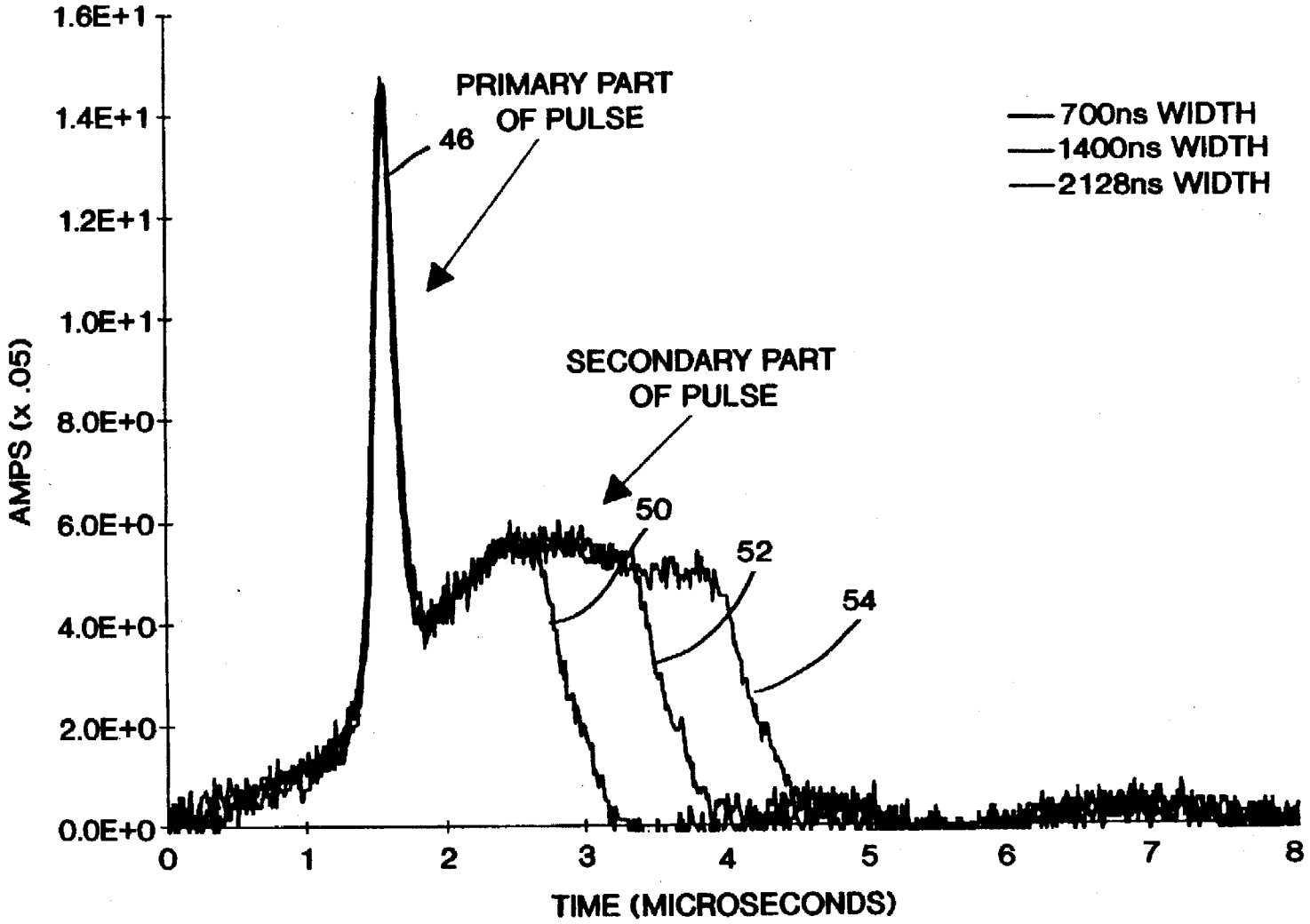
FIG. 8 shows a comparison chart of three current pulses with similar primary pulses, and differing secondary pulse widths.

To distinguish the effects of the primary pulse 46 and the secondary pulse 48, experiments were performed where the primary pulse 46 width was held constant and the secondary pulse 48 width was varied. A trace of some of these current wave forms can be seen in FIG. 8. FIG. 8 is an overlay of three pulses, each having the same primary pulse 46, but with progressively wider secondary pulses 50, 52, and 54.

The primary pulse 46 is the result, more of the lamp diameter, fill gas, fill gas pressure, and electrodes. The primary pulse 46 is designed to be sufficient to ionize the lamp so there is electrical conduction, and to further energize neutral (ground state) neon atoms to their first energy levels. The neon can then emit ultraviolet radiation, which in turn causes the phosphor 26 to emit visible light. The primary pulse 46 is then chosen to effectively stimulate the phosphor 26 to emit visible light. It is generally, understood that an insufficient primary pulse 46 results in no ignition, while too great a primary pulse results in excessive electrode wear, electromagnetic lamp noise and similar problems. Within these constraints, a designer has some opportunity to design the primary pulse 46.

The secondary pulse 48 is chosen the stimulate the neon fill to emit visible light. With insufficient secondary pulse width, the visible neon reds are underdeveloped, so the lamp color is dominated by the stimulated phosphor emissions, for example yellow or green. With too long a secondary pulse, the lamp color is dominated by the visible neon reds. Due to emission duration, and spatial separations, and depending on the timing between the primary pulse 46 and secondary pulse 48, there may be actual time delays between the several color emissions. The lamp can be said to be flashing first with the phosphor yellow or green color, and then, very shortly thereafter flashing with the neon red color. (There may also be emission overlaps.) Since these separate emissions occur faster than a human eye can detect, they are generally integrated by the eye as one color. In particular, the green and red are integrated forming an amber color.

Since the phosphor stimulation is the result of ground state neon atoms being energized to a proper level, it is necessary that after the secondary pulse 48 passes, the neon must be left to sufficiently discharge to regain ground state. An off (or low stimulation) period must then follow the secondary pulse 48. The off (or low stimulation) period must be sufficiently long so that fifty percent or more of the neon reaches ground state before the next primary pulse 46 occurs. (Otherwise there is a build up of neon in the higher excitation states, thereby limiting the UV production.) Returning sufficient neon to ground state may be achieved by an off period of a few microseconds or more. The smallest necessary off time depends on the degree of initial excitation, population levels, statistical decay and other factors. If the off period is too great, the lamp has an undesirable flicker, so the off period should be more than a few and less than about 30 microseconds.

The experiment of holding the primary pulse 46 constant, while widening the secondary pulses 50, 52, 54, showed an important result. The visible component of the lamp emission due to the phosphor did not change, while the visible component due to the direct neon emission varied. When the secondary pulse 48 was widened, the lamp output wattage (or operating power), also increased, so there was more light. However, since the phosphor emission stayed constant despite the increase in power in the secondary pulse 48, the phosphor excitation was independent of the secondary pulse 48. As a result, the ratio of phosphor emission intensity to the neon emission intensity changed.

Figure 9:
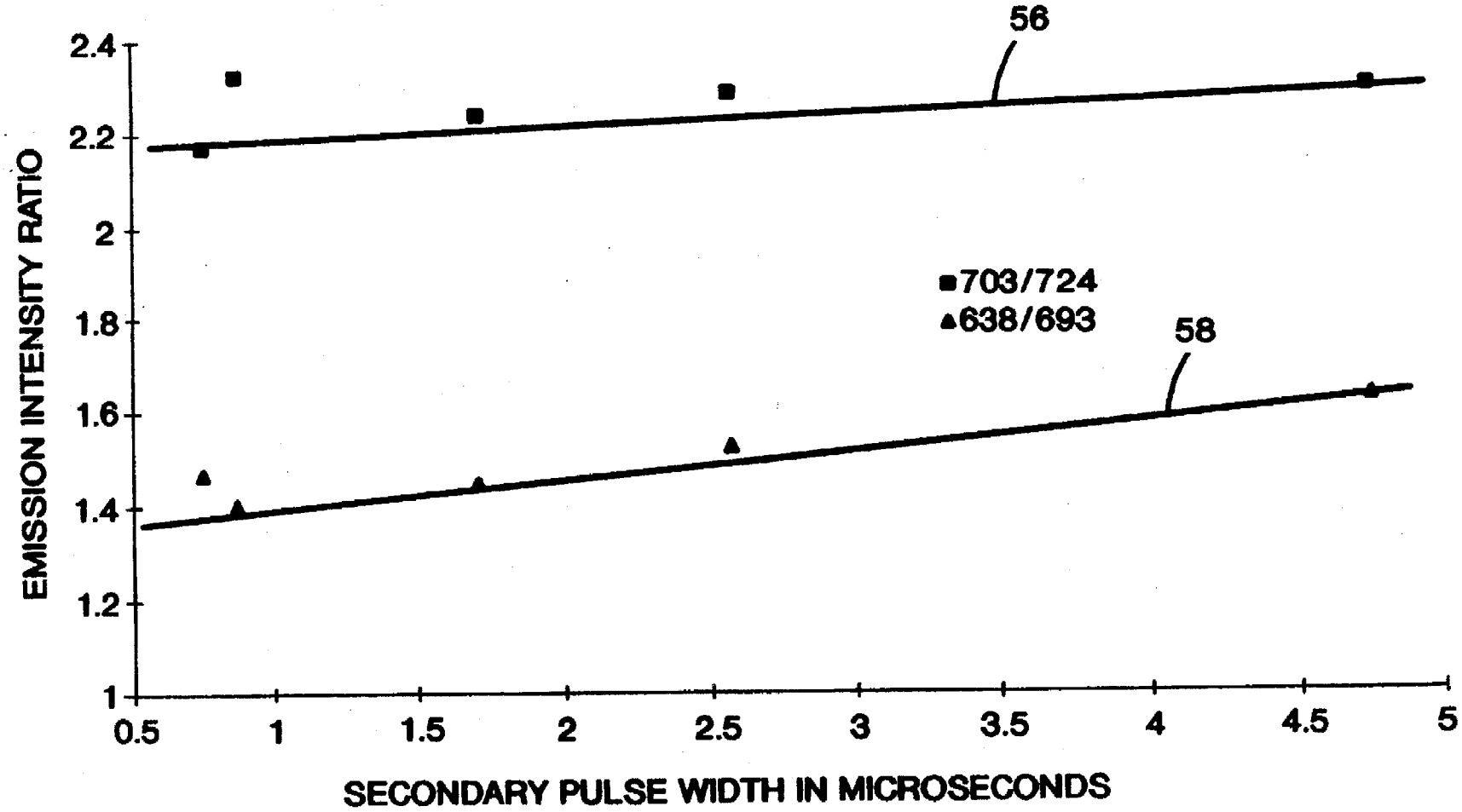
FIG. 9 shows a chart of the relative neon emission ratios of the prominent neon lines when varying the width of the secondary pulse.

FIG. 9 shows a chart of the ratio of the relative emission from the 703 and 724 nanometer lines and the relative emissions from the 638 to 693 nanometer lines taken from the raw spectral data. The upper trend line 56, shows the ratio of the emission intensity between the 703 and the 724 nanometer lines as the secondary pulse 48 is made wider. The lower trend line 58, shows the ratio of the emission intensity between the 638 and the 693 nanometer lines as the secondary pulse 48 is made wider. The chart indicates that as the width of the secondary current pulse 48 increases, both the 703 and 638 populations increase with respect to their matched pairs (693, 724). The chart also indicates that with a wider secondary pulse 48, the emission intensity from the 638/693 lines (line 58) increase faster than the emission intensity from the 703/724 lines (line 56). This increase is magnified by the fact that the 638/693 emission group also has a higher weighting in human perception as compared to the 703/724 group. The trend lines 56 and 58 then indicate that it is possible to increase the overall efficiency of the neon red emission by widening the width of the secondary current pulse 48. In both instances as the secondary pulse 48 width increases, the relative intensity of the lower emission line 58 increases, meaning the emitted light has a more orange color. There is no added increase in phosphor emission during this same increase in the width of the secondary pulse 48. With an increase in red (703 nanometer line), a greater increase in orange (638 nanometer line), and with no change in green (phosphor emission), the resulting chromaticity (amber) changes.

Figure 10:
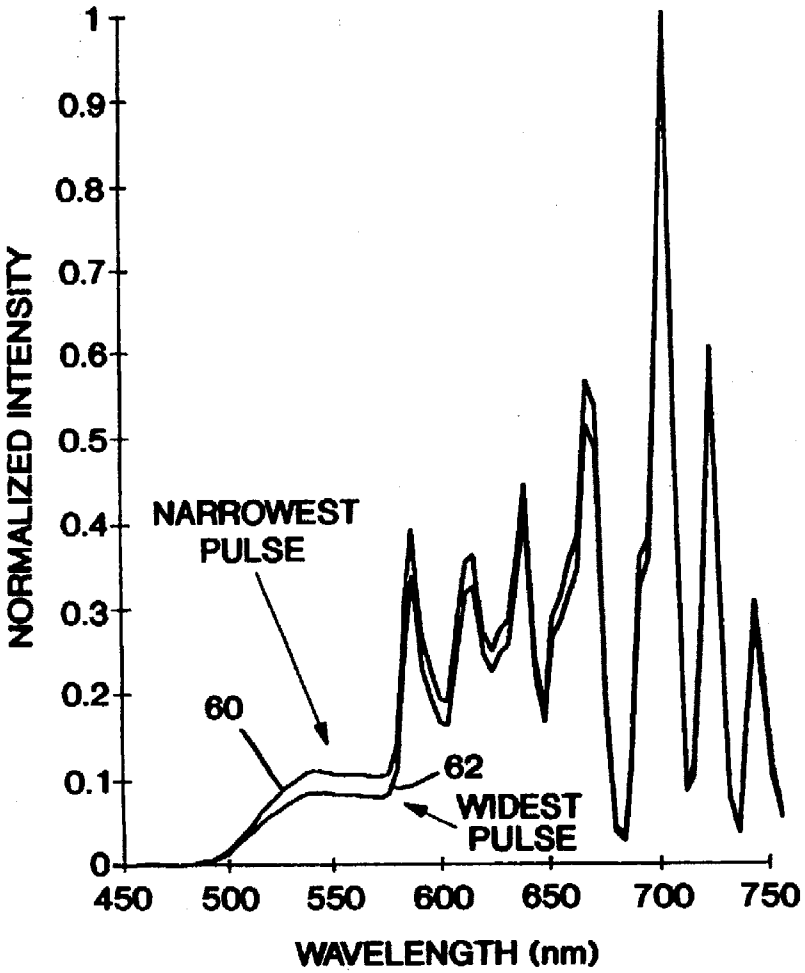
FIG. 10 shows a comparison chart of emissive data from a YAG phosphor coated, neon lamp operated with differing primary pulse widths.

A similar experiment was performed for the primary pulse 48. FIG. 10 shows a comparison chart of emissive data from a YAG phosphor coated, neon lamp operated with differing primary pulse widths. The data has been normalized with the neon 703 line being 100%. While widening of the primary pulse 46, the width of the secondary pulse 48 was held constant to within a few nanoseconds. The spectral intensity for the narrowest primary pulse is shown by trace 60. Generally more emission is shown in the shorter wavelengths (green here). The results for the widest primary pulse is shown by trace 62. The results generally show that as the primary pulse 46 is narrowed, the red emission from neon does not change, but the orange emission increases. FIG. 10 indicates that the normalized phosphor emission depends on the width of the primary pulse 46. The narrower the primary pulse 46, the greater the normalized intensity of the phosphor emission. The normalized decrease in red and increase in orange and green is an advantage for generating amber.

It is believed that the 703 nanometer neon line feeds the metastable level of the neon atom. An increase in the metastable population may then account for the reabsorption of the 703 nanometer emission. However, the 724 line terminates on the level which has an allowed transition at 74.3 nanometers. An increase in the metastable population would not account for absorption of the 724 nanometer emission.

FIG. 11 shows a comparison chart of spectral radiance from similar neon lamps using three different coating thicknesses of a YAG phosphor. The lamp emitted light is the combination of the visible phosphor and gas emissions. The chart indicates that as the phosphor coating thickness increases for the same pulse excitation, the phosphor emission increases slightly, but appears to saturate between 36 and 50 microns. The absorption of the visible neon emission also increases. Because of the absorption of the visible neon emission, the neon lamp may lose some overall efficacy with a thicker coating. On the other hand, the power supply (ballast) may no longer need to produce such relatively narrow pulses to generate the same amber color as compared to the lighter coatings.

Figure 12A:
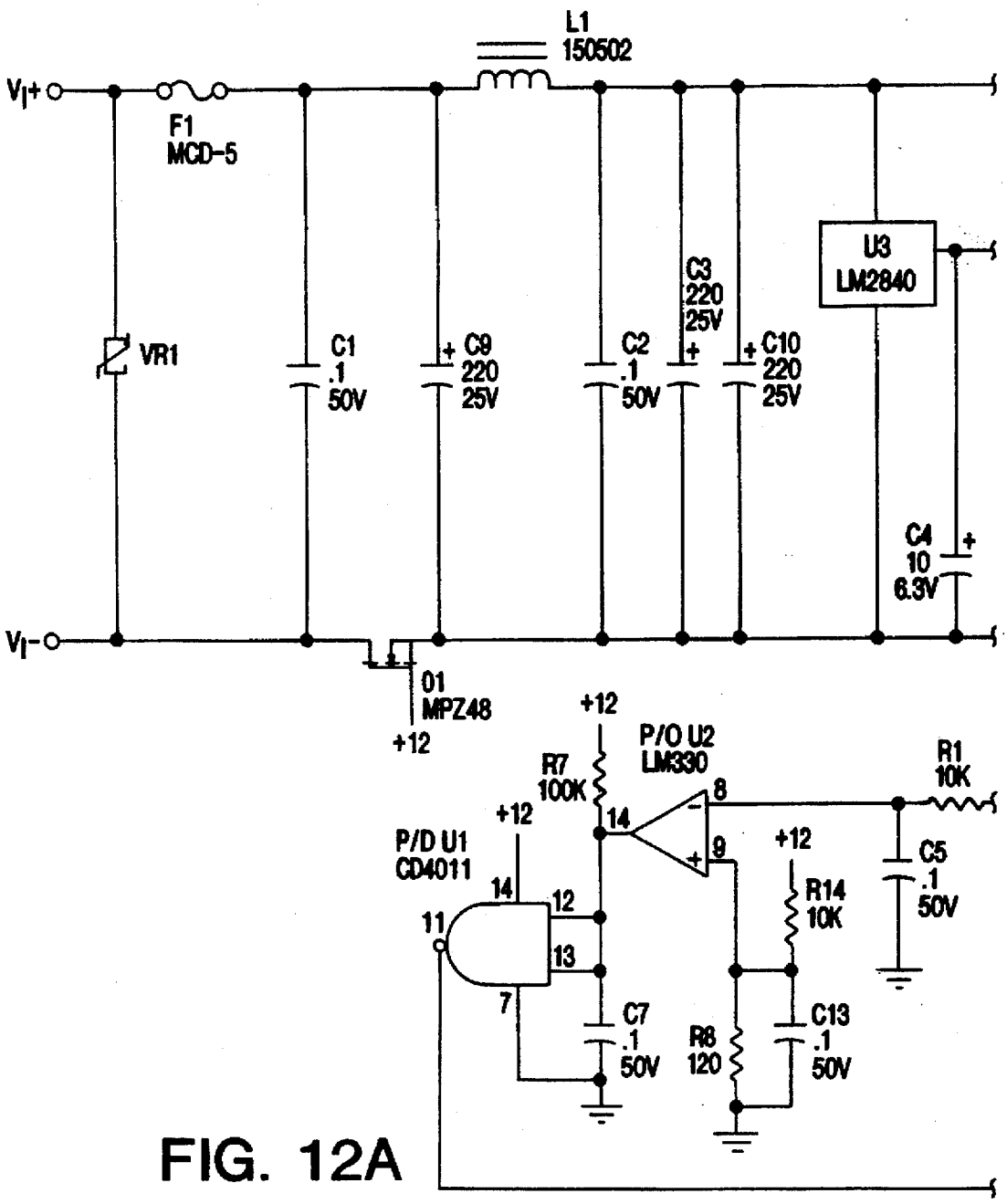
FIG. 12 shows a circuit diagram for a 25 watt pulsed power source for a neon, phosphor coated lamp.
Figure 12B:
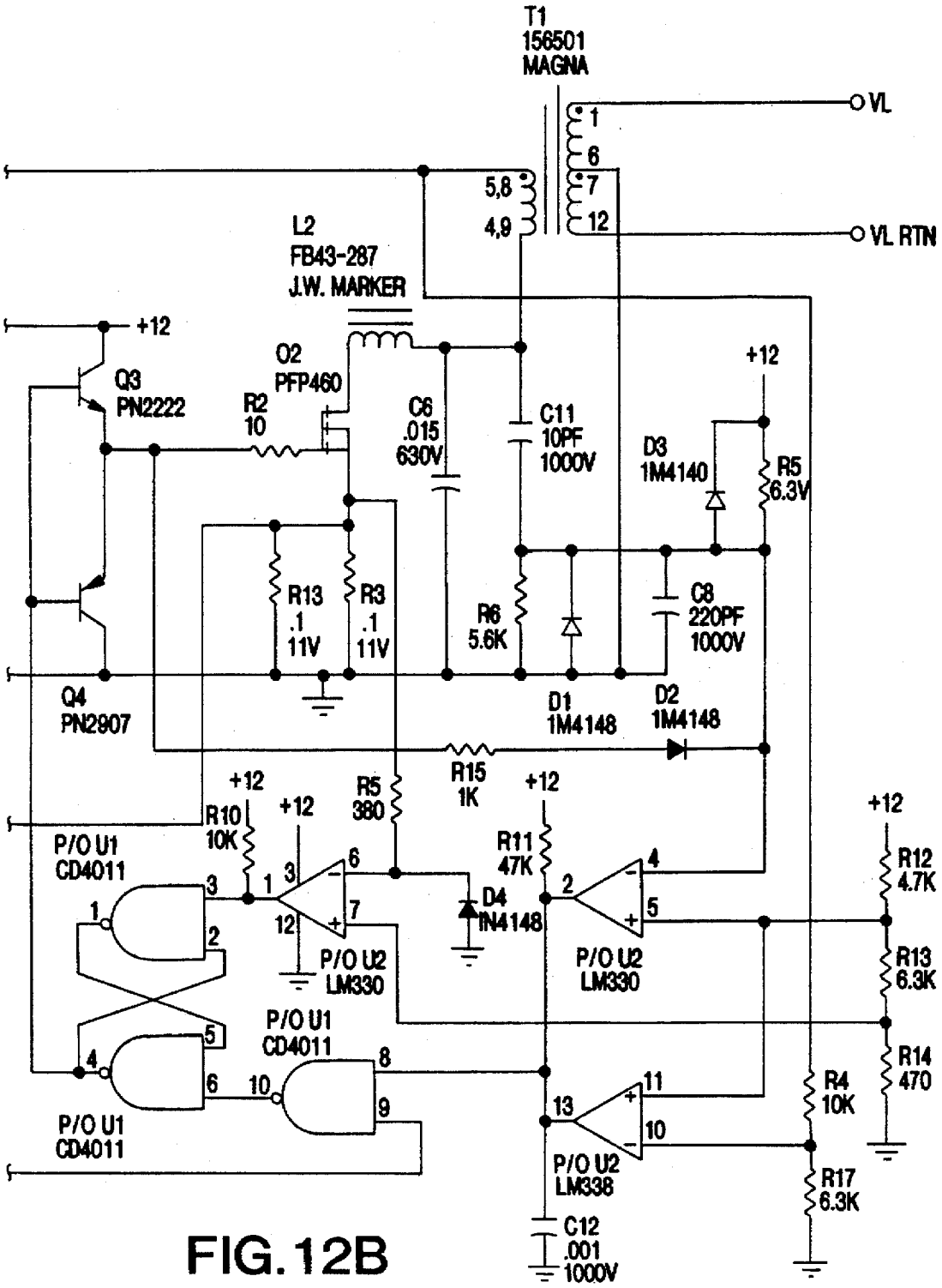

A pulse ballast was designed to deliver 25 watts into the neon, phosphor coated, 16 inch, 3 millimeter ID by 5 millimeter OD, 100 torr lamp. The ballast produced a narrow primary pulse 46 with little or no secondary pulse 48 at a frequency of 25 kHz. With this ballast, the neon lamp system generated 360 lumens at 23 watts (15.65 lumens per watt) with chromaticity values of X=0.572 and Y=0.418. FIG. 12 shows a circuit diagram of a ballast to achieve pulsed power into a 25 watt neon lamp.

To produce a European automotive amber lamp, the chromaticity values of the lamp must meet the European (ECE) amber color specifications. As indicated in FIG. 6, the neon lamp with the YAG phosphor did not meet the ECE specification. The lamp output was slightly outside the ECE color specification (region 42) by approximately 0.002 in the X chromaticity coordinate. The X color coordinate translates to a small deficiency in the red. The lamp is then slightly orange.

Figure 13:
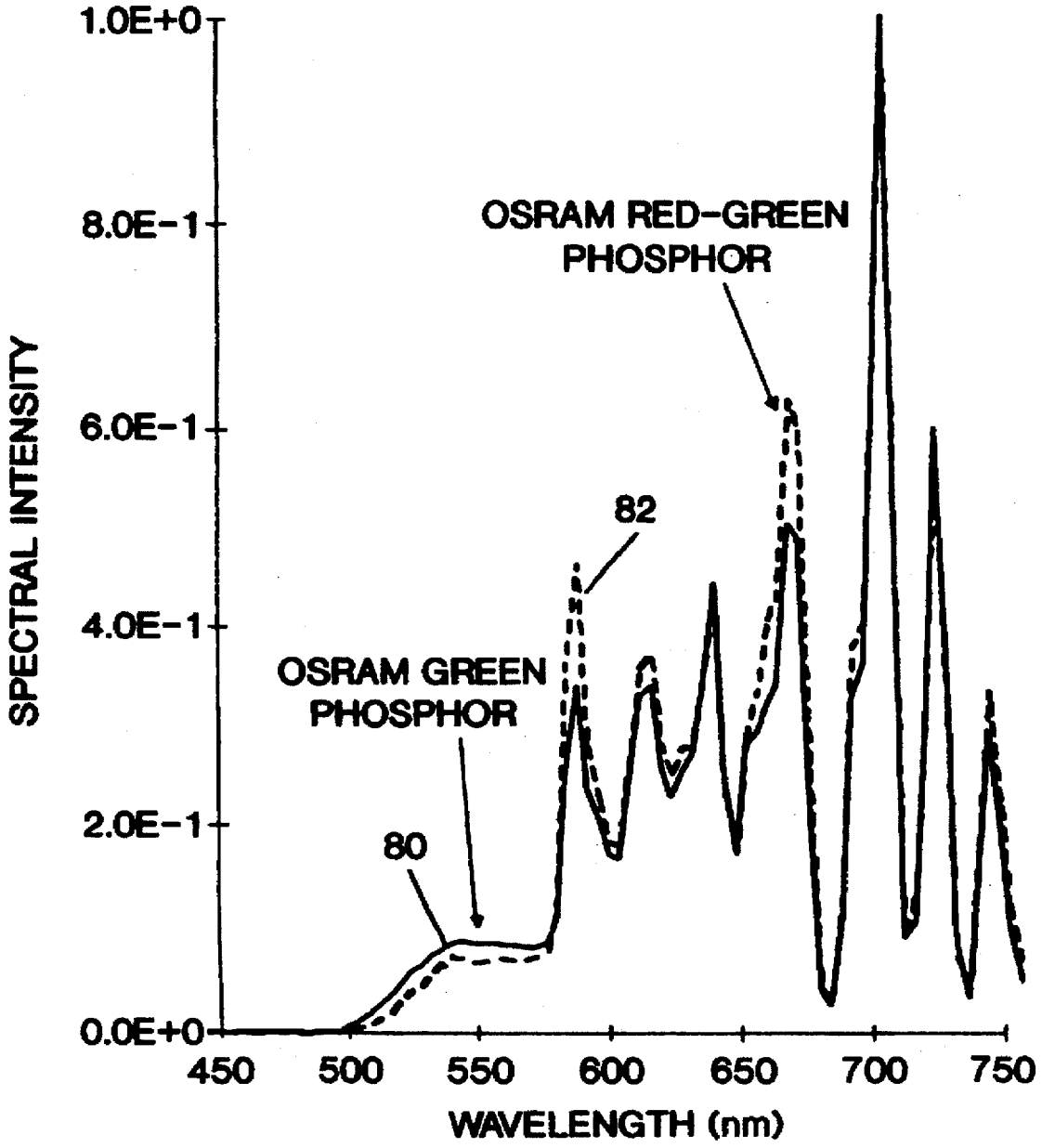
FIG. 13 shows a comparison chart of the relative spectral differences between a YAG phosphor lamp and a mixed YAG and red phosphor lamp.

One solution to generate more red is to add a red phosphor to the phosphor coating for the neon lamp. A red phosphor (Sylvania type 236, magnesium flurogernate: manganese) with an excitation between 300 and 350 nanometers and fundamental chromaticity values of X=0.742 and Y=0.291, was chosen. Various blends were tested experimentally and a mixture ratio of 10% red to a 90% green (YAG) phosphors was found to be the best. With this ratio, the red and green phosphors coating on the neon lamp, along with the neon red emission were found to generate a lamp chromaticity values of X=0.589 and Y=0.407 under narrow pulse excitation. This value was inside the SAE and the ECE specification zone. FIG. 13 shows a chart of the relative spectral differences between the YAG (green) phosphor lamp (trace 80) and the YAG and Sylvania 236 type (green and red) mixed phosphor lamp (trace 82).

A neon lamp when electrically pulsed can be an effective vacuum ultraviolet emitter. The vacuum ultraviolet radiation emitted by a neon discharge can be used as an efficient source for phosphor excitation. A phosphor coated neon lamp can be operated as an amber light source for automotive lighting. A 40.64 centimeter (16 inch) low pressure neon lamp running at 23 watts of pulse power can generate an efficacy of 15.65 lumens per watt with chromaticity values of X=0.572 and Y=0.418.

In summary the best pressure to meet the SAE amber chromaticity is from 20 to 220 Torr of pure neon, depending in part on the lamp length. The best pressure for electrical efficiency is as small as possible, while the best pressure for sputtering control is greater than 50 Torr and more preferably 70 Torr to 150 Torr. The best frequency for candela efficiency is from 12 to 17 kHz for a 25 centimeter (10 inch) long lamp. It is understood that a sufficient amount of energy is necessary to be applied for a chosen duty cycle to ionize the lamp, and that a sharp crest in the applied primary pulse is preferred. Applicants prefer a crest factor greater than 1.41. They have found crest factors of 4 to 8 to be effective, and believe that the higher the crest factor the better the results for phosphor stimulation. While the best practical system frequency is just above the limit of most human hearing or about 20 kHz. The best primary pulse width for candela efficiency is below 400 nanoseconds, and more preferably in the range from 100 to 300 nanoseconds. It should be understood that producing shorter primary pulses is more effective at stimulating the phosphor, but shorter pulses are electronically more difficult. It should also be understood that amber light can be generated from the primary pulse alone, and that no secondary pulse is required. However, operation in this fashion is inefficient.

Lamp power is increased by using a long secondary pulse, that induces more of the neon red. Applicants believe that a secondary pulse of from 5 to 15 microseconds (5,000 to 15,000 nanoseconds) is most efficient in producing direct visible red light. There is then a balancing between the primary pulse, and the secondary pulse, given the chosen phosphor. The shorter the primary pulse, the more the phosphor is stimulated (green); which in turn allows for a longer, more efficient secondary pulse (red). The lamp can then be designed to have the shortest possible primary pulse, with a secondary pulse chosen to balance the phosphor output to thereby give the desirable color. Alternatively, the lamp, may be designed to have the most efficient light production from the secondary pulse, and then choosing a primary pulse and phosphor to balance the final color output. The states in between would also be achievable.

The best off period following the secondary pulse is long enough to let enough of the neon to return to neutral ground state so that the next primary pulse can properly populate the low energy levels for subsequent UV emission. A few microseconds is sufficient.

In a working example some of the dimensions were approximately as follows: The tubular envelope was made of 1724 hard glass, and had a tubular wall with an overall length of 50 centimeters, an inside diameter of 3.0 millimeters, a wall thickness of 1.0 millimeters and an outside diameter of 5.0. Lamps with 5.0 millimeter inside diameters and 7.0 millimeter outside diameters have also been made. The electrodes were made of molybdenum shafts supporting crimped on nickel cups, or tantalum cups. Each nickel cup was coated with an alumina and zirconium getter material, known as Sylvania 8488. The molybdenum rod had a diameter of 0.508 millimeter (0.020 inch). The exterior end of the molybdenum rod was butt welded to a thicker (about 1.0 millimeter) outer rod. The inner end of the outer rod extended into the sealed tube about 2 or 3 millimeters. The thicker outer rod is more able to endure bending, than the thinner inner electrode support rod. The cup lip extended about 2.0 millimeters farther into the envelope than did the rod.

The inside surface of the envelope was coated with a yttrium, alumina, and ceria phosphor. The gas fill was pure neon, and had a pressure ranging from 20 to 220 Torr, preferably about 100 Torr. The lamp was operated at about 21 watts, and it produced 360 lumens for a 17.14 lumens per watt. The lamp light had an amber color with chromaticities values of X=0.572 and Y=0.418 meeting the SAE amber color requirements. The disclosed operating conditions, dimensions, configurations and embodiments are as examples only, and other suitable configurations and relations may be used to implement the invention.

While there have been shown and described what are at present considered to be the preferred embodiments of the invention, it will be apparent to those skilled in the art that various changes and modifications can be made herein without departing from the scope of the invention defined by the appended claims.

What is claimed is:

1. A method of pulsing a positive column discharge lamp having a rare gas fill and a phosphor coating comprising the steps of:

providing pulsed power to the enclosed gas fill, wherein the pulse has at least a first portion prior in time and a second portion later in time, the first portion having a pulse width selected to excite ultraviolet photon emission from the rare gas, and the second portion having a pulse width selected to enhance the additional light output from the rare gas, while applying sufficient voltage and current to cause ionization of the lamp fill.

2. The method in claim 1, wherein the rare gas comprises substantially pure neon.

3. A method of pulsing a positive column discharge lamp having a rare gas fill and a phosphor coating comprising the steps of:

providing pulsed power to the enclosed gas fill, wherein the pulse has at least a first portion prior in time and a second portion later in time, the first portion having a pulse width selected to excite ultraviolet photon emission from the rare gas, and the second portion having a pulse width selected to enhance the additional light output from the rare gas, while applying sufficient voltage and current to cause ionization of the lamp fill, and following the pulse with a period of low stimulation, allowing at least fifty percent of the gas fill to return to ground state.

4. The method in claim 3, wherein the rare gas comprises substantially pure neon.

5. A method of operating a phosphor coated, gas discharge lamp having fill components comprising the steps of a) applying pulsed energy with at least a first portion stimulating enclosed fill components at ground state to emit ultraviolet light thereby causing the phosphor coating to emit visible light, b) applying the pulsed energy with at least a second portion stimulating the fill components to emit visible light, c) following the pulsed energy by a period of at least low stimulation, allowing the at least fifty percent of the stimulated fill components to return to ground state, and d) cycling the steps a, b and c at a rate sufficiently fast that a human eye integrates the total visible emission as a single, flickerfree output color.

6. The method in claim 5, wherein the duration of the second portion is adjusted to alter the relative amount of visible emission from the fill component with respect to the amount of visible emission from the phosphor, thereby adjusting the output color.

7. The method in claim 5, wherein the fill component is substantially pure neon.

8. The method in claim 5, wherein the first pulse portion has a pulse width less than 400 nanoseconds.

9. The method in claim 8, wherein the first pulse portion has a pulse width between 100 and 300 nanoseconds.

10. The method in claim 5, wherein the second pulse portion has a pulse width of not more than 1.5 microseconds.

11. The method in claim 5, wherein the period of low stimulation after the second pulse portion has a duration of more than 1 microsecond.

12. The method in claim 11, wherein the period of low stimulation after the second pulse portion has a duration of less than 30 microseconds.

13. A method of pulsing a discharge lamp having substantially pure neon fill and a phosphor coating comprising the steps of:

providing pulsed power to the enclosed neon, wherein the pulse has at least a first portion prior in time and a second portion later in time, the first portion having a pulse width selected to excite ultraviolet photon emission with an energy sufficient to ionize at least one of the lamp fill components at a first emission frequency, and the second portion having an energy sufficient to ionize a portion of the lamp fill at a second emission frequency, while applying sufficient voltage and current to cause ionization of the lamp fill.

14. A method of operating a rare gas discharge lamp having substantially pure neon fill and a phosphor coating comprising the steps of:

providing pulsed power to the enclosed neon, wherein the pulse has at least a first portion prior in time and a second portion later in time, the first portion having a pulse width selected to excite ultraviolet photon emission with an energy sufficient to ionize at least one of the lamp fill components at a first emission frequency, and the second portion having an energy sufficient to ionize a portion of the lamp fill at a second emission frequency comprising the step of shifting the relative time balance between the time duration of the first component and the time duration of the second component, while applying sufficient voltage and current to cause ionization of the lamp fill.

15. A discharge lamp system comprising a) a light transmissive envelope defining an exterior and an enclosed volume;

b) at least two electrodes sealed in the envelope providing electrical connection from the lamp exterior to the enclosed volume;

c) a substantially pure neon gas fill positioned in the enclosed volume;

d) a phosphor contained in the enclosed volume; and e) a power source providing pulsed power wherein at least some of the pulses include a first portion sufficient to ionize the lamp and stimulate at least some of the enclosed neon fill to a first energy state, and an off portion sufficiently low in stimulation and long in duration to allow half of the neon to return to a neutral ground state.

16. The lamp system in claim 15, wherein the power source further supplies a second portion, substantially in time between the first portion and the off portion, the second portion having sufficient voltage and current to stimulate the neon to emit visible light.

17. The lamp system in claim 16, wherein the phosphor is a combination of a green emitting phosphor and a red emitting phosphor.

18. The lamp system in claim 17, wherein the phosphor is a blend of a YAG phosphor, and a red emitting phosphor.

19. The lamp system in claim 18, wherein the phosphor is a blend of about 90 percent of a YAG phosphor, and about 10 percent of a red emitting phosphor.

20. The lamp system in claim 18, wherein the phosphor is a blend of a YAG phosphor, and a Sylvania type 236 red emitting phosphor.

21. The lamp system in claim 15, wherein the phosphor is a green emitting phosphor.

22. The lamp system in claim 21, wherein the phosphor is a willemite phosphor.

23. The lamp system in claim 21, wherein the phosphor is a YAG phosphor.

24. The lamp system in claim 15, wherein the first portion has a duration of less than 400 nanoseconds.

25. The lamp system in claim 24, wherein the first portion has a duration of from 100 to 300 nanoseconds.

26. The lamp system in claim 16, wherein the second portion has a duration of less than 15.0 microseconds.

27. The lamp system in claim 26, wherein the second portion has a duration of from zero to 5.0 microseconds.

28. The lamp system in claim 15, wherein the off portion has a duration of more than 1.0 microsecond.

29. The lamp system in claim 28, wherein the off portion has a duration of less than 30.0 microseconds.

30. A discharge lamp system comprising a) a light transmissive envelope defining an exterior and a wall with an inside surface defining an enclosed volume;

b) at least two electrodes sealed in the envelope providing electrical connection from the lamp exterior to the enclosed volume;

c) a rare gas fill providing ultraviolet and visible light emission positioned in the enclosed volume;

d) a phosphor stimulated by the ultraviolet emission, the phosphor being coated on the inside surface, and having a thickness chosen to color balance the direct visible emission from phosphor and the transmitted visible emission from the rare gas; and e) a power source providing power to the lamp electrodes wherein at least a first power portion to stimulate at least some of the enclosed rare gas fill to emit ultraviolet light, and a second power portion to cause at least some of the enclosed rare gas fill to emit visible light.

* * * * *